United States Patent [19]

Knaak

[11] 4,056,350

[45] Nov. 1, 1977

[54] SUPPORT RAIL ARRANGEMENT

[75] Inventor: Rüdiger Knaak, Neuss, Germany

[73] Assignee: Koppers-Wistra-Ofenbau GmbH, Dusseldorf, Germany

[21] Appl. No.: 657,107

[22] Filed: Feb. 11, 1976

[30] Foreign Application Priority Data

Feb. 26, 1975 Germany ..... 2508206

[51] Int. Cl.[2] ..... F27D 3/02

[52] U.S. Cl. ..... 432/234; 432/235

[58] Field of Search ..... 432/233, 234, 235, 121, 432/123, 126, 127

[56] References Cited

U.S. PATENT DOCUMENTS

| | | | |
|---|---|---|---|
| 2,435,362 | 2/1948 | Morton | 432/234 |
| 3,214,152 | 10/1965 | Molz | 432/235 |
| 3,236,507 | 2/1966 | McKie | 432/234 |
| 3,367,641 | 2/1968 | Molz | 432/234 |

FOREIGN PATENT DOCUMENTS

| | | | |
|---|---|---|---|
| 1,247,481 | 9/1971 | United Kingdom | 432/234 |

*Primary Examiner*—John J. Camby
*Assistant Examiner*—Henry C. Yuen
*Attorney, Agent, or Firm*—Michael J. Striker

[57] ABSTRACT

A furnace for heat treating of workpieces includes a workpiece-engaging member mounted on an elongated, internally cooled supporting member for supporting workpieces from below which are to be advanced through and heat treated in the furnace. A ceramic material heat-insulating jacket partially surrounds the supporting member for insulating the latter from heat. A protective arrangement is provided on at least one of said members for protecting the ceramic jacket from damage by a workpiece in the event that a workpiece slides off the workpiece-engaging member.

8 Claims, 6 Drawing Figures

SUPPORT RAIL ARRANGEMENT

BACKGROUND OF THE INVENTION

The present invention generally relates to metallurgical furnaces and, more particularly, to improvements in the design and construction of elongated, internally cooled support rails commonly employed in walking beam and so-called pusher-type furnaces.

The function of such rails is to support and to provide for the continuous transport of workpieces, such as ingots, slabs, rods, bars or like heavy metallic workpieces through a heating chamber. The so-called pusher-type furnaces push the workpieces along the elongated support rails and heat the workpieces on all sides thereof.

In such furnaces, the rails are cooled, usually by circulating cooling fluid through interior passages of the rails, so that the rails will not themselves be deformed at the elevated temperatures of the furnace. Thus, direct contact between the workpieces and the rails must be avoided since otherwise undesirable undercooled zones or darkened areas in the region of the workpiece surface which contacts the support will be formed due to the difference in temperature. These undercooled zones are very undesirable because they adversely affect material characteristics, particularly during subsequent rolling.

In order to eliminate the formation of such undercooled zones and to protect the rail from excessive wear, so-called wear-resistant strips, or "riders," or workpiece-engaging elements constituted of heat-insulating material are mounted on the upper side of the rails over the entire length thereof. The workpieces are supported from below on these riders for the purpose of preventing undercooling of those underside portions of the workpieces which would otherwise be in direct contact with the internally-cooled rails.

In addition, in order to insulate the lateral sides and bottom side of the rail, a jacket constituted also of heat-insulating material, such as ceramic material, is placed about the rail.

It is desirable in the construction of metallic furnaces for those skilled in the art to keep the number of support rails as low as possible so that undesirable heat losses can be prevented. Also, the support rails exhibit the further disadvantage that they tend to screen and hinder the flow of heat energy being directed towards the underside of the workpiece because of their very presence. For the same reasons, it is also desirable to keep the spacing between adjacent pairs of rails as large as possible, although this requirement must be counterbalanced by the size of the smallest workpiece which is expected to be advanced through the furnace and, in addition, by the fact that if the rails are located too close to each other, not enough heat will arrive at the underside of the workpiece located between the rails.

Furthermore, in determining the appropriate spacing between the rails, one must keep in mind that the workpieces undergo not only motion in the direction of the elongation of the rail but are also subject to a certain amount of lateral displacement transversely of the rail.

The above considerations dictate, for practical operation, that the length of the workpieces by only very slightly longer than the spacing between the rails. However, such prior art constructions have not proven altogether satisfactory since, in the event that a workpiece slides off the workpiece-engaging elements as a result of inadvertent or careless handling, the workpiece first falls on the ceramic jacket and fractures the same and thereupon falls to the furnace floor.

As a result, the rails are no longer heat-insulated and, in a furnace which operates at elevated temperatures for heat-treating of steel workpieces, the heat loss to the exposed rails and the consumption of cooling fluid per unit surface area and time is increased almost by a factor of 10 times. Even if, for example, only one-tenth of the ceramic jacket is chipped away, the heat loss and consumption of cooling fluid is increased up to two times.

SUMMARY OF THE INVENTION

Accordingly, it is a general object of the present invention to overcome the disadvantages of the prior art.

Another object of the present invention is to protect a ceramic jacket surrounding the support rail from damage in the event a workpiece slides off a workpiece-engaging member mounted on the rail.

An additional object of the present invention is to increase the heating efficiency of metallurgical furnaces.

Still another object of the present invention is to make the operation of such metallurgical furnaces more economical.

In keeping with these objects and others which will become apparent hereinafter, one feature of the invention, briefly stated, resides in a combination in a furnace for the heat treatment of workpieces which comprises an elongated, internally cooled supporting member for supporting workpieces which are to be advanced through and heat-treated in the furnace. A wworkpiece-engaging member is mounted on the supporting member and has an upper portion adapted to support a workpiece from below. Insulating means, preferably constituted of ceramic material, partially surrounds the supporting member in the nature of a jacket and insulates the supporting member from heat. Finally, protecting means is provided on at least one of said members for protecting the insulating means from damage by a workpiece in the event that a workpiece slides off the upper portion of the workpiece-engaging member.

In accordance with the invention, the protecting means comprises an outwardly-tapering element which overlies the inwardly-facing side of the jacket which is normally subject to damage by a workpiece which slides off the upper portion of the workpiece-engaging member. The protective element is constituted of a rigid material whose strength is greater than that of the material which constitutes the heat-insulating jacket so that the force of a falling workpiece can be absorbed and diverted away from the heat-insulating jacket. In this manner, the jacket is protected from possible damage and the heating efficiency of the metallurgical furnace is correspondingly increased.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 2:
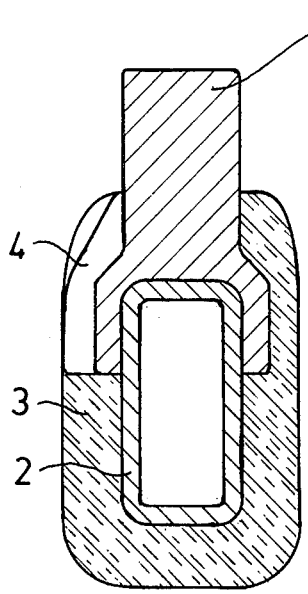
FIG. 2 is a view, in vertical section, of FIG. 1 along the line in the direction having the arrows II—II.
Figure 1:
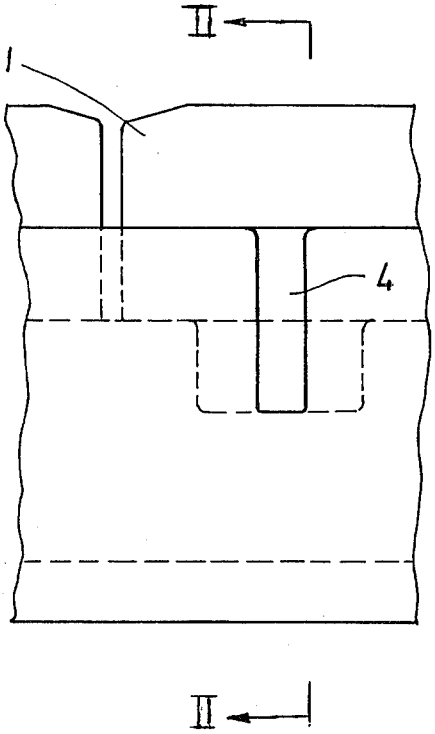
FIG. 1 is a partial side view of an embodiment in accordance with the present invention.

Referring firstly to a first embodiment of the support rail, as illustrated in FIGS. 1 and 2, it will be seen that reference numeral 1 generally identifies a workpiece-engaging member mounted on an elongated, internally cooled supporting member 2 which supports workpieces which are to be advanced through and heat-treated in a metallurgical furnace or like heating chamber. The workpiece-engaging member or rider 1 has an upper portion which is adapted to support a workpiece from below. A plurality of such riders 1 are mounted over the entire elongation of the supporting member 2 which extends from the input towards the output of the furnace, each rider 1 being slightly spaced apart from the next successive rider 1 so that room is left for heat expansion.

Heat-insulating means or jacket 3 is constituted of heat-resistant metal material or preferably ceramic material and partially surrounds the supporting member 2 so as to insulate the cooled interior of the latter from the surrounding heat of the furnace.

Protecting means or protective element 4 is provided on at least one of said members, i.e., rider 1 and/or supporting member 2, for protecting the jacket 3 from damage by a workpiece in the event that a workpiece slides off the upper portion of the rider 1. In FIG. 2, it will be seen that the protective element 4 is provided solely on rider 3. The element 4 is configurated so that it has an outer portion extending outwardly of the supporting member 2 in direction transversely of the elongation of the supporting member, i.e., towards the left of FIG. 2. This outer portion is tapered in direction outwardly and downwardly away from the upper portion of the rider 1 so that it entirely overlies the left side portion of the jacket 3, i.e., the side portion of the jacket which is normally subject to damage by a workpiece which slides off the rider 1. It will be understood that this aforementioned jacket side portion is the one which faces another corresponding jacket side portion of another non-illustrated rail which is laterally spaced with respect to the illustrated rail. These two rails cooperate to support a workpiece from below, and it is their respective inwardly facing sides which are normally the ones which require protection due to inadvertent or careless handling or the workpieces.

In order to insure that no portion of the jacket can be damaged, the element 4 diverges away from the rider 2 until it is spaced a predetermined distance from the supporting member 2 which is approximately equal to the thickness of the left side portion of the jacket. In addition, FIG. 2 illustrates that the element 4 need not continually linearly taper from its upper to its lower portion. The width dimension of element 4 is preferably narrow as illustrated in FIG. 1.

Figure 4:
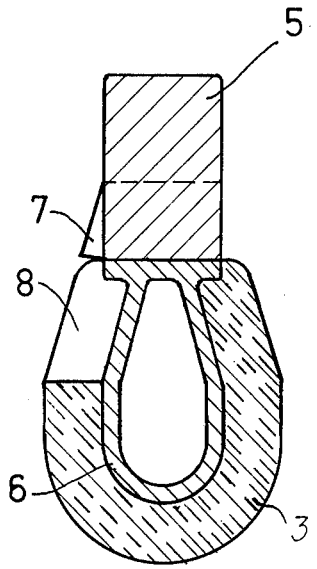
FIG. 4 is a view, in vertical section, of the embodiment of FIG. 3 along the line having the arrows IV—IV.
Figure 3:
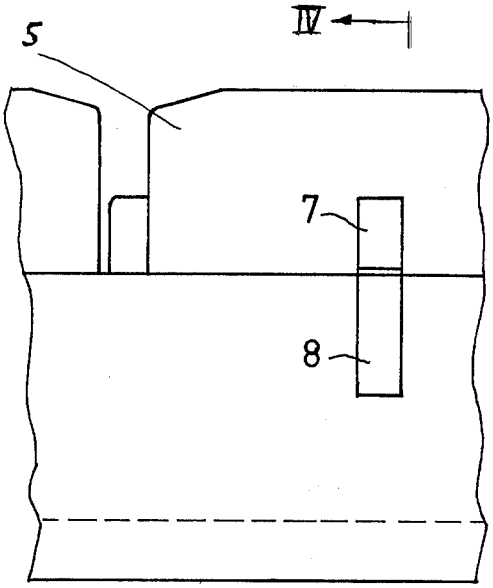
FIG. 3 is a partial side view of another embodiment in accordance with the present invention.

Turning now to a second embodiment of the support rail, as illustrated in FIGS. 3 and 4, it will be seen that the supporting member is identified with reference numeral 6, the rider is identified by reference numeral 5, the heat-insulating means is identified by reference numeral 3, and the protecting means is now identified by reference numerals 7 and 8.

In this embodiment, the protecting means is of two-piece construction. A piece 7 is connected with rider 5; and a piece 8 is connected with supporting member 6. Pieces 7 and 8 linearly taper outwardly and, in other respects, are generally analogous to the one-piece protecting element 4 previously discussed in connection with the embodiment of FIGS. 1 and 2.

Figure 6:
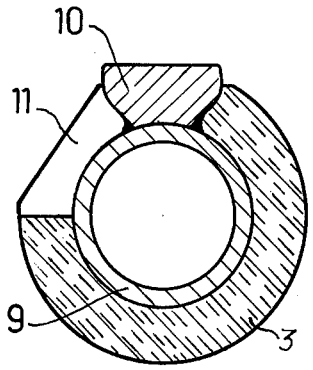
FIG. 6 is a view, in vertical section, of the embodiment of FIG. 5 along the line having the arrows VI—VI.
Figure 5:
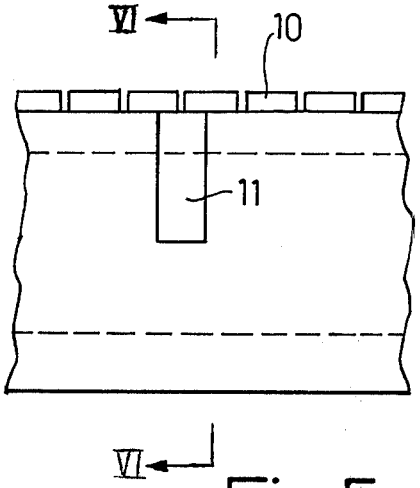
FIG. 5 is a partial side view of still another embodiment in accordance with the present invention.

Turning lastly the third embodiment of the support rail, as illustrated in FIGS. 5 and 6, it will be seen that reference numeral 9 generally identifies the supporting member, reference numeral 10 generally identifies a wear-resistant strip or rider, reference numeral 3 again identifies the heat-insulating means, and reference numeral 11 identifies the protecting means. In this embodiment, the protecting means is constituted of one-piece construction and is provided on both the rider 10 and the supporting member 9. Again, the protective element 11 continuously linearly extends outwardly so as to entirely overlie the leftmost jacket side portion 3. With respect to all of the embodiments, it will be understood that the cross section of the supporting member can have any configuration. Thus, the supporting member may have either a rectangular, complex geometrical, or circular shape as respectively illustrated in FIGS. 2, 4 and 6. It will be further understood that the cross section of the workpiece-engaging element may also have any configuration. Thus, the workpiece-engaging element may straddle the supporting member, or only engage an upper mounting surface of the supporting member, or be welded onto the supporting member, as respectively illustrated in FIGS. 2, 4 and 6. No matter which particular arrangement is chosen, the workpieces falling off the workpiece-engaging element is kept away from the jacket 3 by the protecting means in order to prevent possible damage to the jacket.

The protecting means is constituted of any rigid material such as steel, cast iron, or any heat-resistant metallic alloy. The width dimension of the protective element is preferably approximately 2 centimeters, and the spacing between successive protective elements which are spaced along the elongation of the supporting rail is preferably about 20 centimeters. Of course, if small metallic workpieces as billets are to be advanced through the furnace, the distance between successive protective elements is correspondingly reduced.

As noted above, the rails are generally internally-cooled, preferably by circulating high-pressure steam or hot water through an interior passage bounded by the supporting member. If the heat-insulation were damaged under such conditions, then heat flows at about 200.00 kcal/m$^2$h occur. This would generate undesirable heat-induced mechanical stresses. By protecting the heat-insulating jacket, it is possible to safely operate under such desirable high-pressure cooling conditions.

The protective element are especially desirable in the case where heavy slabs are to be advanced through the furnace since the elements help to prevent side-slippage and tend to reinforce the support rail.

In the case where only one supporting rail is employed in the furnace, it will be understood that the workpieces are balanced on only one upwardly-facing surface of a rider. In this event, either one side or both sides of the rider may be protected by the above-described protective elements.

It will be understood that each of the elements described above, or two or more together, may also find a useful application in other types of constructions differing from the types described above.

While the invention has been illustrated and described as embodied in a support rail arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a furnace for heat treating workpieces, a combination comprising an elongated, internally cooled supporting member for supporting workpieces which are to be advanced through and heat treated in the furnace; a workpiece-engaging member mounted on said supporting member and having an upper portion adapted to support a workpiece from below; insulating means partially surrounding said supporting member for insulating the latter from heat; and protecting means provided on at least one of said members for protecting said insulating means from damage by a workpiece in the event that a workpiece slides off said upper portion of said workpiece-engaging member, said protecting means comprising an element having an outer portion which extends outwardly of said supporting member in direction transversely of the elongation thereof, said insulating means having at least one side portion subject to damage by a workpiece in the event that the latter slides off said workpiece-engaging member, and wherein said outer portion overlies said one side portion of said insulating means.

2. A combination as defined in claim 1, wherein said element has a narrow width dimension as considered in the direction of the elongation of said supporting member.

3. A combination as defined in claim 1, wherein said outer portion of said element has a tapered configuration which diverges in direction away from said upper portion of said workpiece-engaging member.

4. A combination as defined in claim 1, wherein said one side portion of said insulating means has a predetermined thickness, and wherein said outer portion of said element has a tapered configuration which diverges in direction away from said upper portion of said workpiece-engaging member until said outer portion is spaced from said supporting member a predetermined distance which is approximately equal to said predetermined thickness of said one side portion of said insulating means.

5. A combination as defined in claim 1, wherein said element is of one-piece construction and is connected only with said workpiece-engaging member.

6. A combination as defined in claim 1, wherein said element is of one-piece construction and is connected to both said workpiece-engaging member and said supporting member.

7. A combination as defined in claim 1, wherein said element is constituted of steel.

8. In a furnace for heat treating workpieces, a combination comprising an elongated, internally cooled supporting member for supporting workpieces which are to be advanced through and heat treated in the furnace; a workpiece-engaging member mounted on said supporting member and having an upper portion adapted to support a workpiece from below; insulating means partially surrounding said supporting member for insulating the latter from heat; and protecting means provided on at least one of said members for protecting said insulating means from damage by a workpiece in the event that a workpiece slides off said upper portion of said workpiece-engaging member, said protecting means comprising element having an outer portion which extends outwardly of said supporting member in direction transversely of the elongation thereof, said element being of two-piece construction, one of said pieces being connected with said workpiece-engaging member, and the other of said workpieces being connected with said supporting member.

* * * * *